United States Patent [19]

Carlsson et al.

[11] 4,165,454

[45] Aug. 21, 1979

[54] MICROWAVE OVEN

[75] Inventors: Kurt H. Carlsson; Bengt U. Imberg, both of Norrkoping, Sweden; Frans C. de Ronde, Eindhoven, Netherlands; Jan O. Appelquist, Norrkoping, Sweden

[73] Assignee: U.S. Philips Corporation, New York, N.Y.

[21] Appl. No.: 739,976

[22] Filed: Nov. 8, 1976

[30] Foreign Application Priority Data

Nov. 7, 1975 [SE] Sweden ..... 7512484
Jul. 15, 1976 [SE] Sweden ..... 7608087

[51] Int. Cl.[2] ..... H05B 9/06
[52] U.S. Cl. ..... 219/10.55 F
[58] Field of Search ..... 219/10.55 F, 10.55 A, 219/10.55 R; 343/700 MS, 891, 897, 911 R; 333/84 M

[56] References Cited

U.S. PATENT DOCUMENTS

| | | | |
|---|---|---|---|
| 2,937,259 | 5/1960 | DeBell, Jr. | 219/10.55 F |
| 2,937,259 | 5/1960 | Bell, Jr. | 219/10.55 F |
| 2,953,781 | 9/1960 | Donnellan et al. | 333/84 M |
| 2,961,520 | 11/1960 | Long | 219/10.55 F |
| 2,962,716 | 11/1960 | Engelmann | 333/84 M |
| 3,016,536 | 1/1962 | Fubini | 343/700 MS |
| 3,155,975 | 11/1964 | Chatelain | 343/700 MS |
| 3,221,132 | 11/1965 | Staats | 219/10.55 F |
| 3,448,384 | 6/1969 | Scott | 219/10.55 R |
| 3,493,709 | 2/1970 | Lavoo et al. | 219/10.55 F |
| 3,638,226 | 1/1972 | Brooks et al. | 343/895 |
| 3,851,133 | 11/1974 | Dygve et al. | 219/10.55 F |

FOREIGN PATENT DOCUMENTS

| | | | |
|---|---|---|---|
| 721823 | 3/1963 | Canada | 219/10.55 E |
| 1093929 | 12/1960 | Fed. Rep. of Germany | 219/10.55 |

*Primary Examiner*—E. A. Goldberg
*Assistant Examiner*—Bernald Roskoski
*Attorney, Agent, or Firm*—Thomas A. Briody; William J. Streeter; Bernard Franzblau

[57] ABSTRACT

An energy supply arrangement for feeding microwave energy from a microwave source to the oven cavity of a microwave oven. The energy supply arrangement comprises a transmission line of the type having a conductor arranged at a small distance from a ground plane, a so-called micro-strip line. This micro-strip line is arranged within the oven cavity near the bottom wall and is, for example, in the shape of a spiral conductor disposed about a central energy feed point and dimensioned such that it radiates energy into the cavity at the same time that energy propagates along the line.

21 Claims, 10 Drawing Figures

A-A

MICROWAVE OVEN

Figure 1:
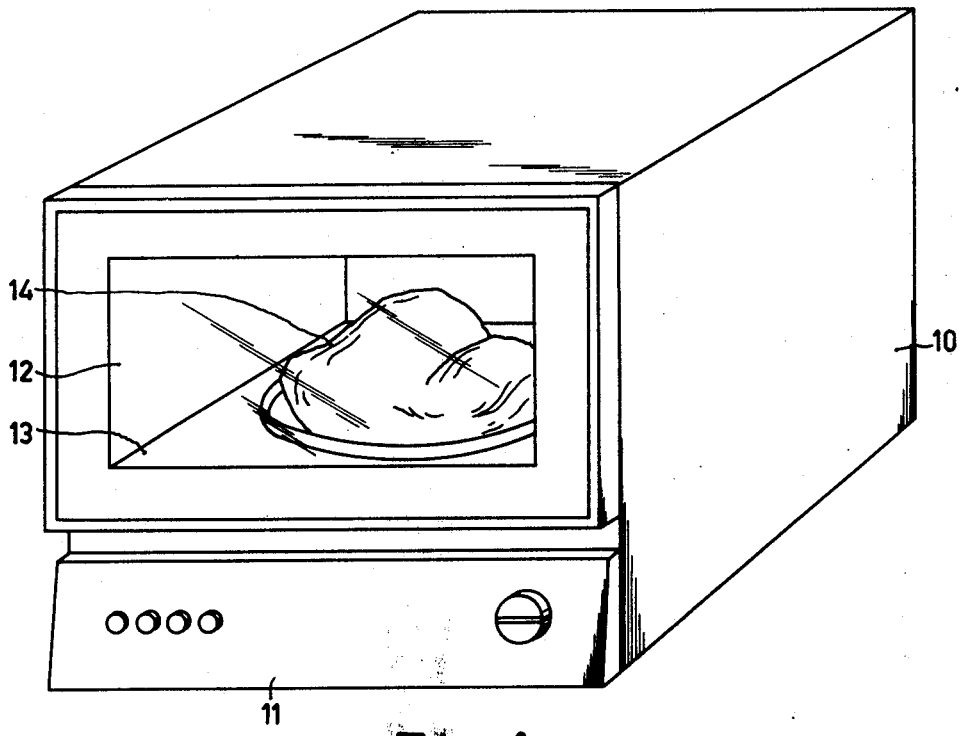

The invention relates to a microwave oven comprising an oven cavity and a microwave source coupled to the cavity through a feeding system which is arranged to directly supply energy to a dielectric substance such, as food, placed in the oven cavity above the feeding system.

Unlike the more conventional microwave ovens which are based on the cavity resonance principle and which aim at a field distribution which is as uniform as possible in the entire oven cavity, the microwave ovens of the type described in the preamble are based on the so-called proximity field principle which aims at generating a field only in one part of the oven cavity, i.e. only at that part of the oven cavity where the goods to be heated are placed. As is well known, this type of microwave oven is non-resonant at the wavelength of the microwave energy source by the proper choice of the oven wall dimensions and the position of the antenna within the oven cavity in relation to the frequency of said energy source. To that end these prior art microwave ovens are provided with a feeding system comprising one or more antennas. German Offenlegungsschrift No. 2410105 discloses a microwave oven in which the feeding system comprises a primary radiator in the form of a dipole antenna combination which is accommodated in an antenna enclosure located under the oven cavity proper and a plurality of secondary radiators in the form of slit radiators arranged in the wall separating the antenna enclosure from the oven cavity proper and on which the food to be heated can be placed. This known construction has the drawback that not only is the desired proximity field produced but also, owing to unwanted resonances, certain standing wave patterns are produced in the oven cavity which, as known, may produce edge burning phenomena. In order to avoid these last mentioned phenomena the primary antenna in a preferred embodiment of this known construction is continuously rotated during heating which, however, renders the construction considerably more complicated. In addition, this known feeding system has the drawback that the radiation field produced by the antenna has a browning effect on the food to be heated. This effect is usually welcomed when preparing meat, but it is not desired for many other kinds of food. Similar drawbacks occur in a microwave oven disclosed in the German Offenlegungsschrift No. 2436120 which is provided with a feeding system having one or more radiators in the form of spiral antennas.

It is an object of the invention to provide a microwave oven of the kind described in the preamble which has a feeding system which mitigates the abovementioned drawbacks to a very great extent and which, moreover, is simple in construction.

According to the invention such a microwave oven is characterized in that the bottom wall of the oven cavity is provided with a feeding system which consists of a transmission line in the form of a flat wire or strip conductor configuration which is parallel to and in the proximity of a subjacent conductive flat plate, this flat wire or strip conductor configuration extending substantially symmetrically with respect to a central feeding point over substantially the entire surface of said oven cavity bottom wall.

Mention should be made here of U.S. Pat. No. 2,937,259 which discloses a microwave oven comprising a feeding system consisting of a transmission line which is formed by a wire conductor which is disposed at a given distance from the oven cavity upper wall. The relevant microwave oven, however, is of the type which is based on the cavity resonance principle and the use of the transmission line as a feeding system aims at producing a more uniform field distribution in the oven cavity.

Figure 2A:
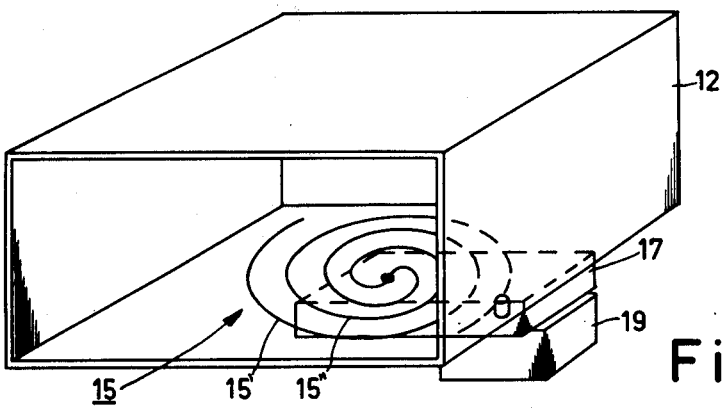
Figure 2B:
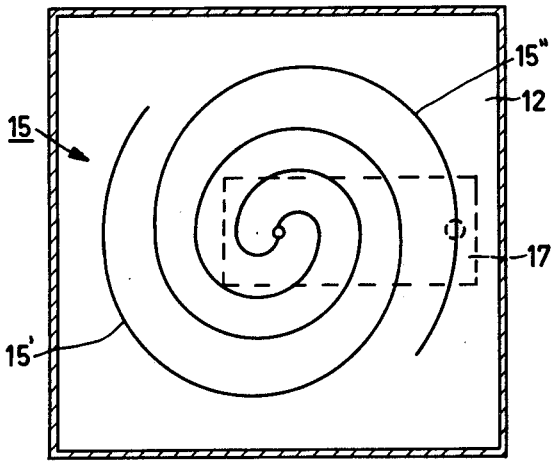
Figure 2C:
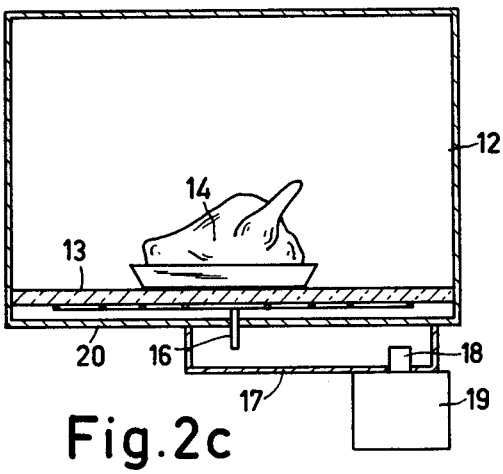
Figure 3A:
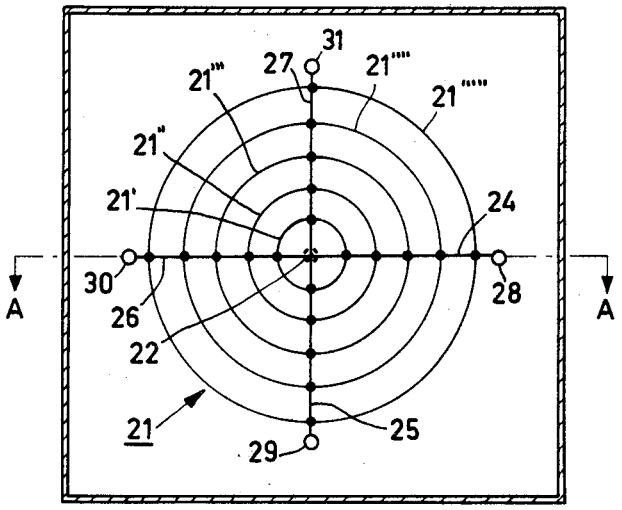
Figure 3B:
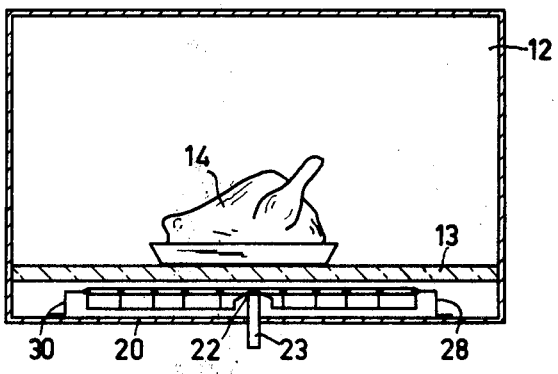
Figure 3C:
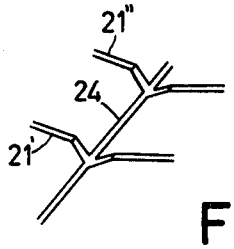
Figure 4:
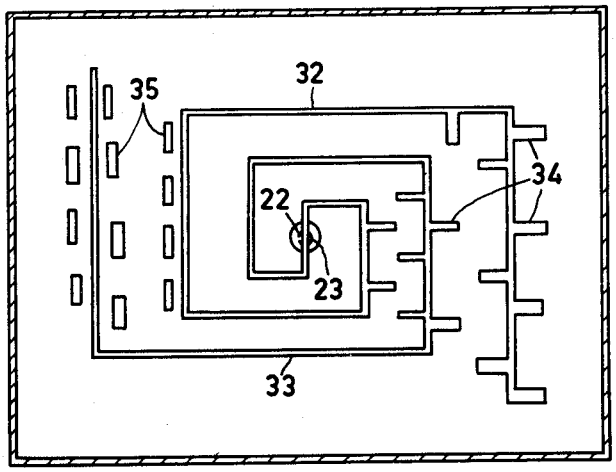
Figure 5:
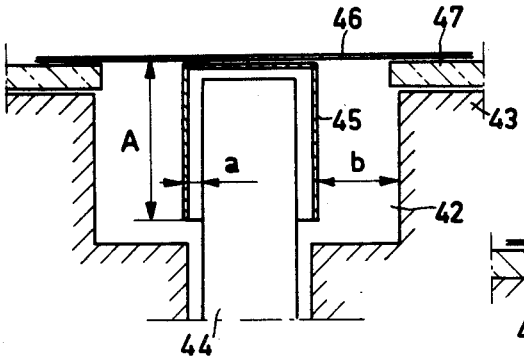
Figure 6:
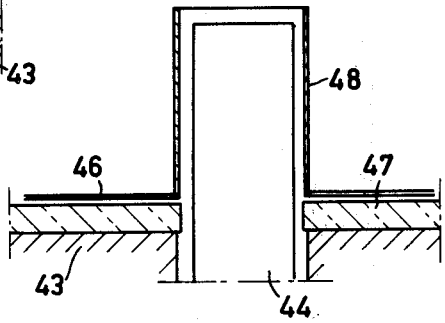

The invention will be further explained with reference to the accompanying drawing in which FIG. 1 is a perspective view of a microwave oven according to the invention, FIG. 2*a* shows a perspective view of the oven cavity in the oven shown in FIG. 1 having a feeding system according to a first possible construction, FIGS. 2*b* and 2*c* show a horizontal sectional view and a vertical sectional view respectively through the same cavity with the feeding system, FIGS. 3*a* and 3*b* show a horizontal and a vertical sectional view respectively of an oven cavity having a second possible construction of the feeding system, FIG. 3*c* shows a detail of the feeding system shown in FIGS. 3*a* and 3*b*, FIG. 4 shows a horizontal cross-sectional view through an oven cavity having a third possible construction of the feeding system, and FIGS. 5 and 6 diagrammatically show different ways in which a direct coupling between a magnetron antenna and the wire or strip conductor configuration can be achieved.

FIG. 1 shows a microwave oven consisting of an outer envelope 10 limited by conductive walls, an actuating panel 11 and an oven cavity 12, the bottom wall 13 of which acts as a support for the food 14 to be heated. As shown by FIG. 2*a*, in the cavity immediately below the place where the food is placed there is a transmission line 15 which in the construction shown is formed by two spriral wire or strip conductors 15', 15''. These wire or strip conductors 15', 15'' are connected at the centre to a metal probe 16. The metal probe 16 projects from the bottom plate 20 of the oven 12 into a waveguide 17 (see also FIG. 2*c*) at the opposite end of which the outcoupling antenna 18 of a magnetron 19 projects into the waveguide 17. The spiral-shaped transmission line 15 is disposed on the bottom side of the bottom wall 13 which serves as a support located at a given distance from the conductive bottom plate 20. This bottom plate 20 serves as a ground plane and the spiral-shaped wire or strip conductors 15', 15'' constitute, together with the ground plane, a so-called micro-strip line. The metal probe and the near ends of the wire or strip conductors may be coupled by means of a galvanic contact, a capacitive coupling or an impedance transformer (choke).

The far ends of the wire or strip conductors are open in the above example but they may be connected to the bottom plate at one or more points. Alternatively, the conductors may be terminated with matched, energy-dissipating impedances, for example in the form of ferrite elements, so as to have a load in the oven at all times, especially in the case where the oven cavity is empty.

The distance between the wire or strip conductors 15' and 15'' and the bottom plate 20 which serves as a ground plane has been chosen such that it is somewhere between the value $\lambda/100$ which results in an optimum transmission line (minimum radiation) and the value $\lambda/4$ which results in an optimum antenna function (maximum radiation). The distance between the wire or strip conductors and the ground plane may have a value which is between λ/25 and λ/5. For an oven having an operating frequency of 2450 MHz a value λ/8=15 mm appeared to be a proper choice. Next to a proper choice of the distance between the conductors and the ground plane, the desired quantity of radiation may be obtained by a proper choice of the width of the strip conductors in the case where strip-shaped conductors are used.

Energy of the magnetron is transmitted via the waveguide 17 to the metal probe 16 and from there to the centre of the transmission line 15 which consists of the two spiral-shaped microstrip conductors 15', 15''. The energy propagates from the centre through the two conductors 15' and 15'' to the open ends thereof. At the same time that the energy propagates along the conductors they radiate energy into the oven cavity and produce a proximity field in the oven cavity whose strength rapidly decreases in the radial direction away from the central feeding point. It appears that if the food to be heated is placed in the intended place centrally within the oven, the directed radiation which is concentrated upon the central portion of the oven is substantially fully absorbed by the food. It appeared that for most loads the oven cavity as such was not excited into resonance because the oven wall dimensions and the position of the radiating transmission line within the oven cavity are related to the frequency of the microwave energy source so as to inhibit the development of resonant modes within said oven cavity.

If the cavity bottom wall is rectangular instead of square, the spirals may be oval-shaped instead of circular, as shown in the drawing, so that the conductors together cover the main part of the rectangular bottom wall. Instead of two spirals, as in the example, any number of spirals may be chosen, for example four interleaved spirals or even one spiral. Each spiral should surround the central feeding point at least once in a suitable manner, as shown in the example. The radiating microstrip conductors may be disposed on the bottom side of the bottom wall 13 which also acts as a support for the substance to be heated.

The bottom wall 13 may consist of a low-loss dielectric material but it may also consist, wholly or partly, of a high-loss dielectric material in order to effect an additional heating by means of a direct contact between the bottom wall 13 and the food placed thereon. The wire or strip conductors may be fastened to the bottom side of the oven cavity bottom wall 13 by means of a suitable cement. The wire or strip conductors may also be formed on the bottom side of the bottom wall 13 by means of metal plating or metal deposition. The radiating transmission line may also be supported by the bottom wall of the oven cavity by means of λ/4 supports which are fastened to the conductors at suitable places.

FIGS. 3*a* and 3*b* show a further embodiment of the feeding system in an oven according to the invention. In FIG. 3*b* is shown the oven cavity 12 having a bottom wall 13 above the bottom plate 20 and with the food 14 to be heated placed on the bottom wall. At the underside of the bottom wall there is a wire or strip conductor configuration 21 which, however, is not in the form of a spiral but which, as is shown in FIG. 3*a* consists of a plurality of concentric circular conductors 21', 21'', 21''', 21'''' and <''''' which are located in one plane and which are fed from a centrally located feeding point 22 via a metal probe 23. The metal probe 23 is directly coupled to a magnetron (not shown) and is connected to the concentric circular conductors via four radially arranged conductors 24, 25, 26 and 27. The conductors 24–27 are located close to the conductive bottom plate 20 and therefore do not radiate because of their proximity thereto. As shown in the drawing the conductors 24–27 may, for example, be connected at each cross-point to the concentric circular radiating conductors 21'–21'''''. FIG. 3*c* shows the shape of such a cross-connection. The entire conductor system is supported by the bottom plate by means of λ/4 supports 28, 29, 30 and 31.

The function of the feeding system shown in FIG. 3 is in principle the same as that of the arrangement described above. Thus, a travelling wave will propagate from the central feeding point through the radial conductors 24–27 to each of the circular conductors 21'–21'''''. The travelling wave is passed on from one circular conductor to the other, the conductors radiating energy at the same time. As a result of this radiation the energy at the radiating conductors rapidly decreases in a direction outwards from the central feeding point so that the main part of the radiation takes place in the central portion of the oven. If food to be heated is placed in the centre of the oven this food substantially absorbs all of the energy and the oven cavity will not be excited into resonant modes.

In the case where the oven cavity bottom wall 13 is rectangular instead of square the circular conductors may, if so desired, be replaced by elliptical conductors so that they extend across the entire surface of the bottom wall 13. It is also not necessary for the conductors to be connected to the radial line at each cross-point between the respective radial conductor and the circular or elliptical conductors. It is sufficient that each circular or elliptical conductor is connected in at least one point to a radial conductor which is connected to the central feeding point and the number of radial conductors may have any suitable value.

FIG. 4 shows a horizontal cross-section through an oven according to the invention which comprises another wire or strip conductor configuration. As in the preceding example, metal probe 23 represents a central feeding point 22. The metal probe 23 projects through a hole in the bottom wall of the oven cavity and is directly coupled to a magnetron antenna (not shown). Two strip conductors 32 and 33 extend from this central feeding point, which conductors are in the example shown in the form of "square sprirals". In addition a plurality of radiating elements which are all in the form of λ/2-long strips are coupled to these conductors. The drawing shows a few examples as to how to arrange these radiating elements and how to couple them to the spiral-shaped conductors. According to the right-hand part of FIG. 4 the radiating elements 34 project substantially perpendicularly from the conductors and are DC coupled thereto. The left-hand part of FIG. 4 shows another possibility according to which the radiating elements 35 are arranged in parallel with the respective conductors and at a small distance therefrom. In that case the radiating elements are coupled inductively to the conductors. The spiral-shaped conductors and the radiating elements are located in the same plane and are, for example, arranged against the underside of the oven cavity bottom wall at a small distance from the bottom plate.

The operation is as follows: A travelling wave propagates from the central feeding point along the conductors and causes the radiating elements to resonate. In that case both the conductors and the radiating elements release energy in the form of radiation. The use of the additional radiating elements enhances the distribution of the radiated energy over the bottom surface. Parameters which determine the local radiation of energy at any place are the distance between adjacent radiating elements and the width of the elements. If the radiating elements are applied in parallel with the conductors the distance between the radiating elements and the conductors is an additional parameter which determines the local radiation. Another parameter which determines the local radiation is, of course, the configuration of the radiating conductors. Combining these parameters in a suitable manner provides a very accurate energy distribution.

FIG. 5 shows a method of making a direct coupling between the magnetron and the wire or strip conductors so that the waveguide 17 (in FIG. 2*c*) can be dispensed with. As shown in FIG. 5 a recess 42 is provided in the oven cavity bottom wall 43 and the antenna 44 of the magnetron projects into this recess. The magnetron antenna 44 is enveloped by a cylinder 45. At the closed end this cylinder is connected to a wire or strip conductor 46 which is located in a dielectric plate 47. The length A of the cylinder is approximately $\lambda/4$, for example approximately 30 mm; so that the infinite impedance at the open end of the cylinder is transformed to a very low impedance at the closed end where the magnetron antenna changes into the wire or strip conductors. The distance a between the magnetron antenna 44 and the enveloping cylinder 45 is comparatively small, for example approximately 1 mm, the distance b between the cylinder 45 and the side wall of the recess 42 being comparatively large, for example larger than 10 mm.

FIG. 6 shows a further method of making a direct coupling between the magnetron and the wire or strip conductors. In FIG. 6 one will recognize the bottom wall 43 of the oven cavity, the magnetron antenna 44, the dielectric plate 47 and the wire or strip conductor 46. However, in this case the antenna 44 is enclosed by a cylinder 48 which is open at both ends and from which the wire or strip conductor 46 extends at the end which is nearest to the oven cavity bottom wall. Also in this case the cylinder is $\lambda/4$ long so that the infinite impedance at the inwardly facing open end is transformed to a very low impedance at the opposite end where the magnetron antenna passes into the wire or strip conductor.

In both cases the wire or strip conductors may extend radially from the conductive cylinders 45 and 48 respectively and be in the form of a spiral, for example as shown in FIG. 2*b* or FIG. 4.

What is claimed is:

1. A microwave oven comprising opposed top and bottom wall surfaces and interconnecting side wall surfaces defining an oven cavity, a microwave energy source coupled to the oven cavity via a feeding system which is arranged to directly supply energy via a central feeding point to a dielectric load substance to be placed in the oven cavity above the feeding system, the feeding system comprising an energy radiating transmission line in the form of a flat wire or strip conductor configuration which is located adjacent to the bottom wall of the oven cavity parallel to and near a conductive flat plate arranged below said transmission line, and wherein the flat wire or strip conductor configuration extends substantially symmetrically with respect to the central energy feeding point over substantially the entire surface of said bottom wall of the oven cavity.

2. A microwave oven as claimed in claim 1 wherein said wire or strip conductor configuration comprises a plurality of spiral-shaped conductors arranged in the same plane and each of which at least partly surrounds the central feeding point.

3. A microwave oven as claimed in claim 2, wherein each of the spiral-shaped conductors surrounds the central feeding point at least once.

4. A microwave oven as claimed in claim 1, wherein said wire or strip conductor configuration comprises a plurality of conductors which form concentric rings around the central feeding point, and means connecting at least one point on each of said rings to the central feeding point.

5. A microwave oven as claimed in claim 1 wherein the bottom wall of the oven cavity comprises a plate of dielectric material and the wire or strip conductor configuration is arranged against the underside of said plate of dielectric material.

6. A microwave oven as claimed in claim 5, wherein said dielectric material has a relatively high dielectric constant.

7. A microwave oven as claimed in claim 5, wherein said plate of dielectric material constitutes the support for the dielectric load substance to be heated.

8. A microwave oven as claimed in claim 5 wherein the conductor configuration which is arranged against the underside of the oven cavity bottom wall is formed by wire conductors arranged in a convoluted configuration which provides a maximum radiation field intensity about the central energy feeding point and which decreases radially outward therefrom.

9. A microwave oven as claimed in claim 5 wherein the conductor configuration which is arranged against the underside of the oven cavity bottom wall is formed by strip conductors which are applied thereto by the deposition of small metal particles.

10. A microwave oven as claimed in claim 1, wherein the distance between the wire or strip-conductor configuration and the conductive plate situated therebelow lies in the range between $\lambda/25$ and $\lambda/5$, where $\lambda$ is the wavelength of the energy of said microwave source.

11. A microwave oven as claimed in claim 10 wherein said conductive plate comprises the bottom plate of the oven casing.

12. A microwave oven as claimed in claim 1 wherein the wire or strip-conductor configuration is coupled to a plurality of resonant elements in the shape of conductive wire strips each having a length equal to a half wavelength or an even number of half wavelengths of the operating frequency.

13. A microwave oven comprising a conductive wall structure including opposed top and bottom wall surfaces which define an oven cavity and an energy feeding point centrally located in the bottom wall surface, means for supporting a dielectric load substance to be heated in a given plane located closer to the bottom wall than to the top wall and spaced apart therefrom, antenna means arranged within the oven cavity in a plane located between said bottom wall surface and said given plane and in close proximity to the given plane so as to directly supply microwave energy to a dielectric load substance placed within the oven cavity, said antenna means including a strip conductor arranged in a plane parallel to the bottom wall surface so as to form a transmission line therewith which extends substantially symmetrically with respect to the central energy feeding point and over a major part of the bottom wall surface, and means for coupling said antenna means to a source of microwave energy.

14. A microwave oven as claimed in claim 13 wherein the distance between the strip conductor and the bottom wall surface is between $\lambda/25$ and $\lambda/5$, wherein $\lambda$ is the wavelength of the microwave energy of said source.

15. A microwave oven as claimed in claim 13 wherein the strip conductor comprises a plurality of spiral-shaped conductors arranged in the same plane each of which at least partly surrounds the central energy feeding point.

16. A microwave oven as claimed in claim 15 wherein the spiral-shaped strip conductors are spaced from the bottom wall surface a distance equal to one eighth of the wavelength of the microwave energy of said source.

17. A microwave oven as claimed in claim 15 further comprising a plurality of half wavelength resonant strip conductor elements coupled to the spiral-shaped strip conductors.

18. A microwave oven as claimed in claim 13 wherein said strip conductor comprises a plurality of ring-shaped conductors arranged concentrically about the central energy feeding point, and conductor means extending radially from the central energy feeding point and connecting at least one point on each of the ring-shaped conductors to the central energy feeding point.

19. A microwave oven as claimed in claim 13 wherein the supporting means comprises a non-conductive plate supported within the oven cavity parallel to the bottom wall surface and with the strip conductor supported on the lower surface thereof, and the strip conductor has a convoluted configuration.

20. A microwave oven as claimed in claim 13 wherein the supporting means comprises a non-conductive plate mounted within the oven cavity in close proximity to the antenna means, and the oven wall dimensions and the position of the antenna means within the oven cavity are related to the frequency of the microwave energy source so that the oven cavity is non-resonant at the wavelength of said energy source.

21. A microwave oven as claimed in claim 1 wherein the strip conductor transmission line has a convoluted configuration and is coupled to the microwave energy source via an energy feeding point centrally located with respect to said oven cavity bottom wall, the oven wall dimensions and the position of the radiating transmission line within the oven cavity being related to the frequency of the microwave energy source so as to inhibit the development of resonant modes within the oven cavity.

* * * * *